United States Patent [19]

Van Der Eijk et al.

[11] Patent Number: 4,620,920

[45] Date of Patent: Nov. 4, 1986

[54] CATALYTIC CRACKING OF HYDROCARBON OILS FROM TWO MIXTURES BOILING ABOVE THE GASOLINE RANGE

[75] Inventors: Huno Van Der Eijk; Jacobus J. L. Heinerman; Ian E. Maxwell, all of Amsterdam, Netherlands

[73] Assignee: Shell Oil Company, Houston, Tex.

[21] Appl. No.: 761,121

[22] Filed: Jul. 31, 1985

[30] Foreign Application Priority Data

Nov. 22, 1984 [NL] Netherlands ..... 8403551

[51] Int. Cl.[4] ..... C10G 11/18; C10G 69/04

[52] U.S. Cl. ..... 208/86; 208/89; 208/94; 208/113

[58] Field of Search ..... 208/76, 77, 86, 89, 208/92, 94, 113, 120

[56] References Cited

U.S. PATENT DOCUMENTS

| | | | |
|---|---|---|---|
| 2,994,659 | 8/1961 | Slyngstad et al. | 208/113 |
| 3,812,029 | 5/1974 | Snyder | 208/113 |
| 3,856,659 | 12/1974 | Owen | 208/80 |
| 3,894,933 | 7/1975 | Owen et al. | 208/77 |
| 3,951,781 | 4/1976 | Owen et al. | 208/86 |
| 4,179,354 | 12/1979 | Frayer et al. | 208/89 |
| 4,359,379 | 11/1982 | Ushio et al. | 208/120 |
| 4,428,822 | 1/1984 | Jones | 208/76 |

*Primary Examiner*—Brian E. Hearn
*Assistant Examiner*—O. Chaudhuri
*Attorney, Agent, or Firm*—Kimbley L. Muller

[57] ABSTRACT

This invention concerns a process for the preparation of a gasoline boiling hydrocarbon from a mixture of hydrocarbons specifically defined. The hydrocarbon feedstock is a mixture of two hydrocarbon oils with the first hydrocarbon oil having a Conradson carbon test value $C_1$ and % w such that the quotient of $C_1/R$ is higher than 0.8 and a second hydrocarbon oil having a Conradson carbon test number $C_2$ such that the quotient $C_2/R$ is lower than 0.2 wherein R is equal to the reactor carbon requirement for the particular catalytic cracking unit and is between 3 and 8 percent by weight.

22 Claims, No Drawings

CATALYTIC CRACKING OF HYDROCARBON OILS FROM TWO MIXTURES BOILING ABOVE THE GASOLINE RANGE

FIELD OF THE INVENTION

The invention relates to a process for the preparation of gasoline from hydrocarbon oils boiling above the gasoline range.

The preparation of gasoline from hydrocarbon oils boiling above the gasoline range catalytic cracking is employed on a large scale. Gasoline preparation by catalytic cracking is carried out by contacting the hydrocarbon oil to be cracked at an elevated temperature with a cracking catalyst. Catalytic cracking on a technical scale is generally conducted in a continuous process by using an apparatus substantially consisting of a vertically arranged cracking reactor and a catalyst regenerator. Hot regenerated catalyst coming from the regenerator is suspended in the oil to be cracked and the mixture is passed through the cracking reacting in upward direction.

Catalyst, which has become deactivated by carbon deposits is separated from the cracked product, stripped and then transferred to a regenerator, where carbon deposits are removed from the catalyst by burning them off. The cracked product is divided into a light fraction having a high $C_3$ and $C_4$ olefins content, a gasoline fraction, and several heavy fractions, such as a light cycle oil, a middle cycle oil, a heavy cycle oil and a slurry oil. In order to increase the yield of gasoline, one or more of the heavy product fractions can be recirculated to the cracking reactor, and the $C_3$ and $C_4$ olefins present in the light fraction can be converted by alkylation with isobutane into alkylate gasoline.

In catalytic cracking on a technical scale it is an objective to have the amount of heat which is released in the regenerator during the burning off of coke deposits from the catalyst crrespond substantially with the amount of heat required in the cracking reactor, so that the process can be conducted without additional heating or cooling devices having to be installed. In determining reaction conditions under which the catalytic cracking process should be carried out, the reactor carbon requirement of the cracking unit and the Conradson carbon test value of the feed play an important role. The term "reactor carbon requirement" of the cracking unit (R as %w, calculated on catalyst) is used to designate the quantity of carbon that must be deposited on the catalyst in the cracking unit in order to result in the correct amount of heat being released in the regenerator, which in turn corresponds substantially to the amount of heat required in the cracking reactor. For a given feed the amount of carbon deposited in the cracking reactor on the catalyst will generally be larger as the cracking is carried out under more sever conditions. A feed with a higher Conradson carbon test value (C as %w, calculated on feed) during cracking of that feed in the cracking unit under given conditions will generally lead to higher amounts of carbon being deposited on the catalyst in the cracking reactor.

BRIEF DESCRIPTION OF THE INVENTION

Succinctly, the instant invention relates to a process for the preparation of gasoline, in which a mixture of two hydrocarbon oils, both of which boil above the gasoline range, are subjected to catalytic cracking at a temperature between 475° and 550° C. in a catalytic cracking unit having a value for R between 3 and 8%w, in which one hydrocarbon oil has a value for C that the quotient C/R is higher than 0.8, and in which the other hydrocarbon oil has a value for C that the quotient C/R is lower than 0.2, and in which the latter hydrocarbon oil also has a value for N of less than 150 ppmw and a value for T of less than 3%w.

OBJECTS AND EMBODIMENTS

A specific embodiment of this invention resides in a process for the preparation of a hydrocarbon product boiling in the gasoline range from a mixture of hydrocarbon oils boiling above the gasoline range which comprises catalytically cracking said mixture of said hydrocarbon oils in a catalytic cracking unit having a reactor carbon requirement (R) between 3 and 8%w, said mixture composed of: (a) a first hydrocarbon oil having a Conradson carbon test value ($C_1$) in percent weight (%w) such that the quotient $C_1/R$ is higher than 0.8 and (2) a second hydrocarbon oil having a Conradson carbon test value ($C_2$) such that the quotient $C_2/R$ is lower than 0.2 and wherein said second hydrocarbon oil has a basic nitrogen content (N) of less than 150 ppmw and a tetra+ aromatics content (T) of less than 3%w.

A more narrow embodiment of this invention resides in the above process wherein the first hydrocarbon oil and the second hydrocarbon oil have respective values for $C_1$ and $C_2$ such that the difference between quotients $C_1/R$ and $C_2/R$ is greater than 8.

Another embodiment of this invention resides in the broader invention above depicted wherein the first hydrocarbon oil has a value for $C_1$ such that the quotient $C_1/R$ is higher than 0.9 and the second hydrocarbon oil has a value for $C_2$ such that the quotient $C_2/R$ is lower than 0.1.

Another embodiment of this invention resides in a process as above depicted with a more narrow definition in that the second hydrocarbon oil has a value for $C_2$ such that the quotient $C_2/R$ is lower than 0.2, and the hydrocarbon oil has a value for N of less than 100 ppmw and a value for T of less than 2%w.

Another embodiment of this invention resides in a process for the catalytic conversion of a hydrocarbonaceous feed mixture boiling above the gasoline boiling range in the presence of a cracking conversion catalyst comprising a zeolite in a cracking reactor having a reactor carbon requirement (R) between 3 and 8%w to a hydrocarbon product boiling in the range of $C_5$ to 221° C., the improvement comprising the selection of the feed admixture in accordance with:

(a) 30 parts to 70 parts of a first hydrocarbon oil having a Conradson carbon test value ($C_1$) in percent weight (%w) such that the quotient $C_1/R$ is higher than 0.8 and (b) 70 parts to 30 parts of a second hydrocarbon oil having a Conradson carbon test value ($C_2$) in percent weight (%w) such that the quotient $C_2/R$ is lower than 0.2 and having a basic nitrogen content (N) of less than 150 ppmw and a tetra+ aromatics content (T) of less than 3%w.

DETAILED DESCRIPTION OF INVENTION

A convenient criterion for assessing the suitability of feeds for a catalytic cracking unit in which cracking is carried out under conditions that a quantity of carbon, which in the cracking reactor is deposited on the catalyst corresponds to R, is the quotient C/R. Generally, a feed will yield more gasoline as the quotient C/R is lower.

During an investigation into the preparation of gasoline by catalytic cracking of hydrocarbon oils boiling above the gasoline range, at temperatures between 475° and 550° C., in a catalytic cracking unit having a value for R between 3 and 8%w, it has now surprisingly been found that the cracking of a specific mixture of two hydrocarbon oils results in a gasoline yield which is much higher than expected under the assumption of linear mixing. In order to attain said increase in gasoline yield, one of the two mixing components is chosen from the group formed by hydrocarbon oils having a C/R>0.8, while the other mixing component should be chosen from the group formed by hydrocarbon oils having a C/R<0.2 and which in addition has a basic nitrogen content (N) of less than 150 ppmw and a tetra+ aromatics content (T) of less than 3%w. It has been unexpectedly found that if the two mixing components are well chosen, 20% more gasoline can be prepared from the resultant specific mixture than expected to date under the assumptions of linear mixing.

In the process according to the instant invention the two mixing components have a C value such that the difference between the quotients C/R of the mixing components is bigger than 0.6. Preferably, the mixing components have a C value such that said difference is bigger than 0.8. It is preferred that one of the two mixing components has a C value such that the quotient C/R is higher than 0.9, whereas the other mixing component preferably has a C value such that the quotient C/R is lower than 0.1. As for the values for N and T of the mixing component having a C value such that the quotient C/R is lower than 0.2, preference is given to hydrocarbon oils having an N value of less than 100 ppmw and a T value of less than 2%w.

In the process according to this invention, one preferred mixing component has a C value such that when the quotient C/R is higher than 0.8, such as a residue obtained via the distillation of a crude mineral oil, which residue has optionally been subjected to a deasphalting treatment. Residues obtained via atmospheric distillation of a crude mineral oil and distillation residues obtained in the vacuum distillation of an atmospheric residue of a crude mineral oil are eligible as mixing components. Special preference is however given to atmospheric distillation residues. A preferred mixing component with a C value such that the quotient C/R is lower than 0.2 is a heavy distillate obtained via the distillation of a crude mineral oil, which distillate has optionally been subjected to a catalytic hydrotreatment. Heavy distillates obtained via atmospheric distillation of a crude mineral oil and heavy distillates obtained via vacuum distillation of an atmospheric residue of a crude mineral oil are eligible as mixing components. Special preference is given to hydrocarbon oils which have been prepared by applying a catalytic hydrotreatment to a heavy distillate obtained via vacuum distillaion of an atmospheric distillation residue of a crude mineral oil. A vacuum distillate subjected to catalytic hydrotreatment preferably has a C value such that the quotient C/R is lower than 0.4 and a value for N of more than 300 ppmw and a value for T of more than 2.9%w. The catalytic hydrotreatment of the vacuum distillate is preferably carried out at a temperature of 275°-450° C., and in particular at a temperature of 300°-425° C., a hydrogen pressure of 25-80 bar and in particular a hydrogen pressure of 30-70 bar, a space velocity of 0.1-5 $1.1^{-1}.h^{-1}$ and in particular a space velocity of 0.2-3 $1.1^{-1}.h^{-1}$ and $H_2$/feed ratio of 100-2000 $Nl.kg^{-1}$ and in particular a $H_2$/feed ratio of 200-1500 $Nl.kg^{-1}$. A preferred catalyst for hydrotreating the vacuum distillate is a sulphided catalyst comprising nickel and/or cobalt together with molybdenum and/or tungsten supported on a carried chosen from alumina, silica, or silica-alumina as carrier.

The weight ratio of the two components in the specified mixture which is catalytically cracked according to this invention may vary within wide ranges. Preferably mixtures are used for which the weight ratio of the two components lies between 30:70 and 70:30 and in particular between 40:60 and 60:40.

The catalytic cracking according to the invention is preferably carried out at a temperature of 485°-540° C. and in particular at a temperature of 495°-530° C., a pressure of 1-10 bar and in particular a pressure of 1.5-7.5 bar, a space velocity of 0.25-4 $kg.kg^{-1}.h^{-1}$ and in particular a space velocity of 0.5-2.5 $kg.kg^{-1}.h^{-1}$ and a catalyst renewal rate of 0.1-5 and in particular a catalyst renewal ratio of 0.2-2, kg of catalyst per 1000 kg of feed. In the catalytic cracking preference is given to the use of a zeolitic catalyst.

The invention is now illustrated with the aid of the following.

ILLUSTRATIVE EMBODIMENT

In order to prepare gasoline with a boiling range of $C_5$-221° C., nine experiments (Experiments 1-9) were carried out in a catalytic cracking unit having a R value of 5%w. Three feeds defined below were used in the cracking: Feed 1, Feed 2 and a mixture of Feed 1 and 2.

Feed 1=a 370° C.+ residue obtained via atmospheric distillation of a crude mineral oil with the properties shown in Table I.

Feed 2=a 370° C.+ residue obtained via atmospheric distillation was hydrotreated at a temperature of 380° C., a hydrogen pressure of 54 bar, a space velocity of 0.9 $g.g^{-1}h^{-1}$ and a $H_2$/feed ratio of 400N $l.kg^{-1}$ over a $Ni/Mo/Al_2O_3$ catalyst. The physical properties of Feed 2 and the pre-hydrotreated Feed 2 precursor are shown in Table 1.

TABLE 1

| Value | Feed 1 | Feed 2 Precursor (before hydrotreatment) | Feed 2 (after hydrotreatment) |
|---|---|---|---|
| T | 5.32% w | 4.65% w | 2.55% w |
| N | 731 ppm w | 461 ppm w | 30 ppm w |
| C | 5.1% w | 1.1% w | 0.4% w |
| C/R | 1.02 | 0.22 | 0.08 |

Both Feed 1 (Experiment 1) and Feed 2 (Experiment 2) were individually cracked in addition to mixtures of Feeds 1 and 2 (Experiments 2 through 8). The results of these tests are shown in Table 2 as well as the space velocities in each applicable experiment. The actual yield of gasoline is shown in Table 2 along with the expected yield calculated by the formula:

expected gasoline yield =

$$\frac{(\%\ w\ \text{Feed 1}) \times 31.1 + (\%\ w\ \text{Feed}) \times 49.0}{100}$$

The gain in gasoline yield is expressed as $$\text{gain } (\%\ w) = \frac{\text{found} - \text{expected}}{\text{expected}} \times 100$$

TABLE 2

| Experiment No. | Feed 1 gew. % | Feed 2 gew. % | Space velocity $kg \cdot kg^{-1} \cdot h^{-1}$ | Gasoline yield, % w on feed: Experimentally Found | Calculated under the assumption of linear mixing | Gain in gasoline yield, % |
|---|---|---|---|---|---|---|
| 1 | 100 | — | 9.2 | 31.1 | — | — |
| 2 | 80 | 20 | 6.4 | 39.9 | 34.7 | 15 |
| 3 | 70 | 30 | 5.5 | 43.4 | 36.5 | 19 |
| 4 | 60 | 40 | 4.8 | 46.1 | 38.3 | 20 |
| 5 | 50 | 50 | 4.2 | 48.1 | 40.1 | 20 |
| 6 | 40 | 60 | 3.7 | 49.3 | 41.8 | 18 |
| 7 | 30 | 70 | 3.4 | 49.8 | 43.6 | 14 |
| 8 | 20 | 80 | 3.0 | 49.7 | 45.4 | 9 |
| 9 | — | 100 | 2.5 | 49.0 | — | — |

What we claim as our invention is:

1. A process for the preparation of a hydrocarbon product boiling in the gasoline range from a mixture of hydrocarbon oils boiling above the gasoline range which comprises catalytically cracking said mixture of said hydrocarbon oils in a catalytic riser reactor having a reactor carbon requirement (R) between 3 and 8%w, said mixture composed of: (a) a first hydrocarbon oil having a Conradson carbon test value ($C_1$) in percent weight (%w) such that the quotient $C_1/R$ is higher than 0.8 and (2) a second hydrocarbon oil having a Conradson carbon test value ($C_2$) such that the quotient $C_2/R$ is lower than 0.2 and wherein said second hydrocarbon oil has a basic nitrogen content (N) of less than 150 ppmw and a tetra+ aromatics content (T) of less than 3%w.

2. The process as claimed in claim 1 further characterized in that said first hydrocarbon oil and said second hydrocarbon oil have respective values for $C_1$ and $C_2$ such that the differences between quotients $C_1/R$ and $C_2/R$ is greater than 8.

3. The process as claimed in claim 1 further characterized in that said first hydrocarbon oil has a value for $C_1$ such that the quotient $C_1/R$ is higher than 0.9 and that said second hydrocarbon oil has a value for $C_2$ such that the quotient $C_2/R$ is lower than 0.1.

4. The process as claimed in claim 1 further characterized in that said second hydrocarbon oil has a value for $C_2$ such that the quotient $C_2/R$ is lower than 0.2, a value for N of less than 100 ppmw and a value for T of less than 2%w.

5. The process as claimed in claim 1 further characterized in that said first hydrocarbon oil possesses a value for $C_1$ such that the quotient for $C_1/R$ is higher than 0.8 is derived from a residue obtained via distillation of a crude mineral oil.

6. The process as claimed in claim 5 further characterized in that said residue obtained via distillation of said crude mineral oil is subject to a deasphalting treatment.

7. The process as claimed in claim 1 further characterized in that said first hydrocarbon oil possessing a value for $C_1$ such that the quotient for $C_1/R$ is higher than 0.8 is derived as a residue of an atmospheric distillation of a crude mineral oil.

8. The process as claimed in claim 1 further characterized in that said second hydrocarbon oil possessing a value for $C_2$ such that the quotient for $C_2/R$ is lower than 0.2 is a heavy distillate derived from distillation of a crude mineral oil.

9. The process as claimed in claim 8 further characterized in that heavy distillate in the presence of a hydrotreating catalyst is catalytically hydrotreated at hydrotreating conditions.

10. The process as claimed in claim 1 further characterized in that said second hydrocarbon oil possesses a value for $C_2$ such that the quotient of $C_2/R$ is lower than 0.2 is a distillate derived from vacuum distillation of an atmospheric distillation residue of a crude oil.

11. The process as claimed in claim 10 further characterized in that said derived distillate is subjected to catalytic hydrotreating in the presence of a hydrotreating catalyst at hydrotreating conditions.

12. The process as claimed in claim 1 further characterized in that said catalytic cracking is performed at a temperature of 495°–530° C., a pressure of 1.5–7.5 bar, a space velocity of 0.5 to 2.5 $kg.kg^{-1}h^{-1}$ and a catalyst renewal rate of 0.2 to 2 kg of cracking catalyst per 1000 kg of feed.

13. The process as claimed in claim 11 further characterized in that said hydrotreating conditions include a temperature of 275°–450° C., a hydrogen pressure of 25–80 bar, a space velocity of 0.1–5 $1.1^{-1}h^{-1}$ and a $H_2$/feed ratio of 100–2000 $N/kg^{-1}$.

14. The process as claimed in claim 9 further characterized in that said hydrotreating conditions include a temperature of 275°–450° C., a hydrogen pressure of 25–80 bar, a space velocity of 0.1–5 $1.1^{-1}h^{-1}$ and a $H_2$/feed ratio of 100–2000$N/kg^{-1}$.

15. The process as claimed in claim 11 further characterized in that said hydrotreating conditions include a temperature of 300°–425° C., a hydrogen pressure of 30–70 bar, a space velocity of 0.2–3 $1.1^{-1}h^{-1}$ and a $H_2$/feed ratio of 100–1500$N/kg^{-1}$.

16. The process as claimed in claim 9 further characterized in that said hydrotreating conditions include a temperature of 300°–425° C., a hydrogen pressure of 30–70 bar, a space velocity of 0.2–3 $1.1^{-1}h^{-1}$ and a $H_2$/feed ratio of 100–1500$N/kg^{-1}$.

17. The process as claimed in claim 11 further characterized in that said hydrotreating catalyst comprises a hydrotreating catalyst having a metal chosen from sulfided nickel, sulfided cobalt and sulfided nickel and sulfided cobalt in accompaniment with a metal or metals chosen from molybdenum, tungsten and a mixture of molybdenum and tungsten supported on a carrier chosen from the group of alumina, silica and silica-alumina.

18. The process as claimed in claim 1 further characterized in that said first hydrocarbon oil and said second hydrocarbon oil are admixed in a ratio of 30:70 to 70:30.

19. The process as claimed in claim 1 further characterized in that said first hydrocarbon oil and said second hydrocarbon oil are admixed in a ratio of 40:60 to 60:40.

20. The process as claimed in claim 1 further characterized in that said catalytic cracking is performed at a temperature of 485°–540° C., a pressure of 1–10 bar, a space velocity of 0.25 to 4 $kg.kg^{-1}h^{-1}$ and a catalyst renewal rate of 0.1 to 5 kg of cracking catalyst per 1000 kg of feed.

21. The process as claimed in claim 12 further characterized in that said cracking catalyst is a zeolite catalyst.

22. In a process for the catalytic conversion of a hydraulic feed mixture boiling above the gasoline boiling range in the presence of a cracking conversion catalyst comprising a zeolite in a riser reactor having a reactor carbon requirement (R) between 3 and 8%w to a hydrocarbon product boiling in the range of $C_5$ to 221° C., the improvement comprising the selection of the feed admixture in accordance with:

(a) 30 parts to 70 parts of a first hydrocarbon oil having a Conradson carbon test value ($C_1$) in percent weight (%w) such that the quotient $C_1/R$ is higher than 0.8 and (b) 70 parts to 30 parts of a second hydrocarbon oil having a Conradson carbon test value ($C_2$) in percent weight (%w) such that the quotient $C_2/R$ is lower than 0.2 and having a basic nitrogen content (N) less than 150 ppmw and a tetra$^+$ aromatics content (T) of less than 3%w.

* * * * *